US008334245B2

(12) United States Patent
Lancon et al.

(10) Patent No.: US 8,334,245 B2
(45) Date of Patent: Dec. 18, 2012

(54) CYLINDER LUBRICANT FOR A TWO-STROKE MARINE ENGINE

(75) Inventors: Denis Lancon, Chassieu (FR); Jean-Marie Bourmaud, Luzinay (FR)

(73) Assignee: Total Raffinage Marketing, Puteaux (FR)

( * ) Notice: Subject to any disclaimer, the term of this patent is extended or adjusted under 35 U.S.C. 154(b) by 30 days.

(21) Appl. No.: 13/000,051

(22) PCT Filed: Jun. 17, 2009

(86) PCT No.: PCT/FR2009/000721

§ 371 (c)(1), (2), (4) Date: Dec. 20, 2010

(87) PCT Pub. No.: WO2009/153453

PCT Pub. Date: Dec. 23, 2009

(65) Prior Publication Data

US 2011/0092403 A1 Apr. 21, 2011

(30) Foreign Application Priority Data

Jun. 18, 2008 (FR) ..... 08 03396

(51) Int. Cl.
*C10L 1/22* (2006.01)
*C10M 159/22* (2006.01)

(52) U.S. Cl. ..... 508/554; 508/391

(58) Field of Classification Search ..... 508/391, 508/554

See application file for complete search history.

(56) References Cited

U.S. PATENT DOCUMENTS 6,004,910 A 12/1999 Bloch et al.
6,242,394 B1 * 6/2001 Chamberlin, III ..... 508/549

FOREIGN PATENT DOCUMENTS

EP 0008193 A1 * 8/1979
FR 2 094 182 A 2/1972
FR 1 914 295 A 4/2008

* cited by examiner

*Primary Examiner* — Walter D Griffin
*Assistant Examiner* — Francis C Campanell
(74) *Attorney, Agent, or Firm* — Rothwell, Figg, Ernst & Manbeck, P.C.

(57) ABSTRACT

The present invention relates to a cylinder lubricant having a BN determined according to standard ASTM D-2896 greater than or equal to 15, preferably greater than 20, preferably greater than 30, advantageously greater than 40 milligrams of potash per gram of lubricant, comprising:

Figure 1:
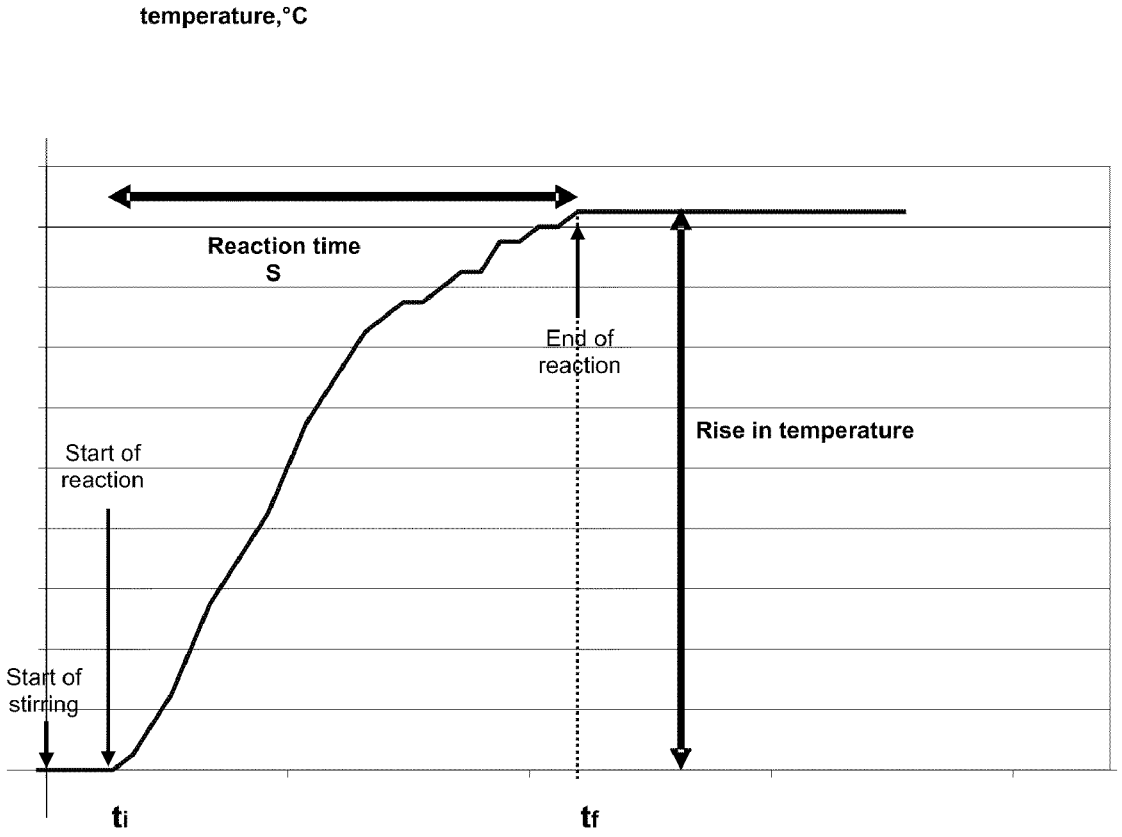

one or more lubricating base oils for marine engines, at least one detergent based on alkali or alkaline-earth metals, overbased with metallic carbonate salts, optionally in combination with one or more neutral detergents, one or more fatty amines and/or derivatives of oil-soluble fatty amines having a BN determined according to standard ASTM D-2896 comprised between 150 and 600 milligrams of potash per gram, preferably comprised between 200 and 500 milligrams of potash per gram.

This lubricant has sufficient neutralization power vis-à-vis the sulphuric acid formed during the combustion of high-sulphur fuel oils, while limiting the formation of deposits during the use of low-sulphur fuel oils.

29 Claims, 1 Drawing Sheet

CYLINDER LUBRICANT FOR A TWO-STROKE MARINE ENGINE

CROSS REFERENCE TO RELATED APPLICATION

This application is a 35 U.S.C. 371 National Phase Entry Application from PCT/FR2009/000721, filed Jun. 17, 2009, which claims the benefit of French Patent Application No. 0803396 filed on Jun. 18, 2008, the disclosure of which is incorporated herein in its entirety by reference.

FIELD

The present invention relates to a cylinder lubricant for a two-stroke marine engine that can be used both with high-sulphur fuel oils and low-sulphur fuel oils. It relates more particularly to a lubricant having sufficient neutralization power vis-à-vis the sulphuric acid formed during the combustion of high-sulphur fuel oils, whilst limiting the formation of deposits during the use of low-sulphur fuel oils.

TECHNOLOGICAL BACKGROUND TO THE INVENTION

Document FR2094182 describes lubricants containing a rust-inhibiting and corrosion-inhibiting additive based on polyalkoxylated compounds, including a C18 amine. The quantity of amine used is very small. It is moreover indicated that the carbonate is the compound used to provide the basicity of the lubricant.

The marine oils used in low-speed two-stroke crosshead engines are of two types. On the one hand, cylinder oils ensuring the lubrication of the cylinder-piston assembly and, on the other hand, system oils ensuring the lubrication of all the moving parts apart from the cylinder-piston assembly. Within the cylinder-piston assembly, the combustion residues containing acid gases are in contact with the lubricating oil.

The acid gases are formed from the combustion of the fuel oils; these are in particular sulphur oxides ($SO_2$, $SO_3$), which are then hydrolyzed on contact with the moisture present in the combustion gases and/or in the oil. This hydrolysis generates sulphurous ($HSO_3$) or sulphuric ($H_2SO_4$) acid.

To protect the surface of piston liners and avoid excessive corrosive wear, these acids must be neutralized, which is generally done by reaction with the basic sites included in the lubricant.

An oil's neutralization capacity is measured by its BN or Base Number, characterizing its basicity. It is measured according to standard ASTM D-2896 and is expressed as an equivalent by weight of potash per gram of oil or mg of KOH/g. The BN is a standard criterion making it possible to adjust the basicity of the cylinder oils to the sulphur content of the fuel oil used, in order to be able to neutralize all of the sulphur contained in the fuel, and capable of being converted into sulphuric acid by combustion and hydrolysis.

Thus, the higher the sulphur content of a fuel oil, the higher the BN of a marine oil needs to be. This is why marine oils with a BN varying from 5 to 100 mg KOH/g are found on the market. This basicity is provided by detergents that are overbased with insoluble metallic salts, in particular metallic carbonates. The detergents, mainly of an anionic type, are for example metallic soaps of a salicylate, phenate, sulphonate, carboxylate type etc. that form micelles where the insoluble metallic salt particles are maintained in suspension. The usual overbased detergents intrinsically have a BN conventionally comprised between 150 and 700 mg KOH per gram of detergent. Their percentage by mass in the lubricant is fixed as a function of the desired BN level.

Part of the BN can also be provided by non-overbased or "neutral" detergents with a BN typically less than 150. However, the production of formulae of marine engine cylinder lubricants where the entire BN is provided by "neutral" detergents cannot be envisaged: it would in fact be necessary to incorporate them in excessive quantities, which could be detrimental to other properties of the lubricant and would not be realistic from an economic point of view.

The insoluble metallic salts of the overbased detergents, for example calcium carbonate, therefore contribute significantly to the BN of the usual lubricants. It can be considered that approximately at least 50%, typically 75%, of the BN of the cylinder lubricants is thus provided by these insoluble salts.

The actual detergent part, or metallic soaps, found in both the neutral and overbased detergents, typically provides most of the remainder of the BN.

Environmental concerns have led, in certain areas and in particular coastal areas, to requirements relating to the limitation of the level of sulphur in the fuel oils used on ships.

Thus, MARPOL Annex 6 (Regulations for the Prevention of Air Pollution from Ships) issued by the IMO (International Maritime Organization) entered into force in May 2005. It sets a global cap of 4.5% m/m on the sulphur content of heavy fuel oils as well as creating sulphur oxide emission control areas, called SECAs (SOx Emission Control Areas). Ships entering these areas must use fuel oils with a maximum sulphur content of 1.5% m/m or any other alternative treatment intended to limit the SOx emissions in order to comply with the specified values. The % m/m rating denotes the percentage by mass of a compound relative to the total weight of fuel oil or lubricating composition in which it is contained.

More recently the MEPC (Marine Environment Protection Committee) met in April 2008 and approved proposed amendments to MARPOL Annex 6. These proposals are summarized in the table below. They present a scenario in which the restrictions on the maximum sulphur content become more severe with a worldwide maximum content reduced from 4.5% m/m to 3.5% m/m as from 2012. The SECAs (Sulphur Emission Control Areas) will become ECAs (Emission Control Areas) with an additional reduction in the maximum permissible sulphur content from 1.5% m/m to 1.0% m/m as from 2010 and the addition of new limits relating to contents of NOx and particles.

| | Current Regulation MARPOL Annex 6 | |
|---|---|---|
| | General Limit | Limit for the SECAs |
| Maximum Sulphur Content | 4.50% m/m | 1.50% m/m |

| | Amendments to MARPOL Annex 6 (MEPC Meeting No. 57 - April 2008) | |
|---|---|---|
| | General Limit | Limit for the ECAs |
| Maximum Sulphur Content | 3.5% m/m on Jan. 01, 2012<br>0.5% m/m on Jan. 01, 2020 | 1% m/m on Jan. 03, 2010<br>0.1% m/m on Jan. 01, 2015 |

Ships sailing trans-continental routes already use several types of heavy fuel oil depending on local environmental constraints whilst making it possible for them to optimize their operating costs. This situation will continue whatever the final level of the maximum sulphur content permissible in fuel oils.

Thus provision is being made on most of the container ships currently under construction for the use of several bunker tanks, for a 'high seas' fuel oil with a high sulphur content on the one hand and for a 'SECA' fuel oil with a sulphur content less than or equal to 1.5% m/m on the other hand.

Changing between these two categories of fuel oil can require adaptation of the engine's operating conditions, in particular the use of appropriate cylinder lubricants.

At present, in the presence of fuel oil with a high sulphur content (3.5% m/m) and more), marine lubricants having a BN in the order of 70 are used.

In the presence of a fuel oil with a low sulphur content (1.5% m/m and less), marine lubricants having a BN in the order of 40 are used (this value is to be reduced in future).

In both these cases, a sufficient neutralization capacity is then achieved as the necessary concentration at basic sites provided by the overbased detergents of the marine lubricant is reached, but it is necessary to change lubricant each time the type of fuel oil is changed.

Furthermore, each of these lubricants has limits of use resulting from the following observations: the use of a 70 BN cylinder lubricant in the presence of a fuel oil with a low sulphur content (1.5% m/m) and less) and a fixed level of lubrication, creates a significant excess of basic sites (high BN) and a risk of destabilization of the unused overbased detergent micelles, which contain insoluble metallic salts. This destabilization results in the formation of deposits of insoluble metallic salts having a high degree of hardness (for example calcium carbonate), mainly on the piston junk, and can in the long term lead to a risk of excessive wear of a piston-liner buffing type.

Therefore, the optimization of the cylinder lubrication of a low-speed two-stroke engine then requires the selection of the lubricant with the BN appropriate to the fuel oil and to the engine's operating conditions. This optimization reduces the flexibility of operation of the engine and requires significant technical skill on the part of the crew in defining the conditions under which the change from one type of lubricant to the other must be carried out.

In order to simplify operations, it would therefore be desirable to have a single cylinder lubricant for two-stroke marine engine that can be used both with high-sulphur fuel oils and with low-sulphur fuel oils.

In particular, a need exists for formulations in which the BN is provided, alternatively to the overbased detergents, by compounds that do not give rise to metallic deposits when they are present in excess relative to the quantity of sulphuric acid to be neutralized.

DESCRIPTION OF THE INVENTION

The purpose of the present invention is to provide a lubricating oil that can ensure good lubrication of the marine engine cylinder and can also withstand the constraints of high-sulphur fuel oils and the constraints of low-sulphur fuel oils.

The present invention relates to lubricating formulations having a sufficiently high BN to effectively neutralize the sulphuric acid formed during the use of fuel oils with a high sulphur content, a significant part of said BN being provided by oil-soluble species that do not give rise to metallic deposits when they are partially consumed, during the use of low-sulphur fuel oil.

The present invention therefore relates to cylinder lubricants having a BN determined according to standard ASTM D-2896 greater than or equal to 15, preferably greater than 20, preferably greater than 30, advantageously greater than 40 milligrams of potash per gram of lubricant, comprising:

one or more lubricating base oils for marine engines, at least one detergent based on alkali or alkaline-earth metals, overbased with metallic carbonate salts, optionally in combination with one or more neutral detergents, one or more oil-soluble fatty amines and/or fatty amine derivatives having a BN determined according to standard ASTM D-2896 comprised between 150 and 600 milligrams of potash per gram, preferably comprised between 200 and 500 milligrams of potash per gram, the percentage by mass of fatty amines and/or of derivatives thereof relative to the total weight of lubricant being chosen such that the BN provided by these compounds represents a contribution of at least 10 milligrams of potash per gram of lubricant, preferably at least 20 milligrams of potash per gram, more preferably at least 30 milligrams of potash per gram, still more preferably at least 40 milligrams of potash per gram of lubricant, to the total BN of said cylinder lubricant and, the percentage by mass of overbased detergents relative to the total weight of lubricant being chosen such that the BN provided by the metallic carbonate salts represents a contribution of at most 20 milligrams of potash per gram of lubricant to the total BN of said cylinder lubricant.

The Applicant found that it was possible to formulate cylinder lubricants in which a significant part of the BN is provided by oil-soluble fatty amines whilst maintaining the level of performance compared with standard formulations with an equivalent BN.

The performances in question here are in particular the capacity to neutralize sulphuric acid, measured using the enthalpy test described in the examples hereafter.

It is however not possible to totally eliminate the BN contribution made by the insoluble metallic particles of the overbased detergents: they constitute the "final reserve" of indispensable basicity when operating with high-sulphur fuel oils (for example greater than 3% m/m, or even 3.5% m/m).

These insoluble metallic salts moreover have a favourable anti-wear effect if they are maintained dispersed in the lubricant in the form of stable micelles.

Furthermore, it was found that the incorporation of amine with too high a content led to a significant reduction in the viscosity of the lubricant, which is hardly compatible with use as cylinder lubricant. This would moreover have a detrimental effect on the toxicity of said lubricants.

The Applicant also found, surprisingly, that in the presence of a significant BN contribution by said fatty amines, too great a BN contribution (greater than 20 mg of potash/gram of lubricant) by the insoluble metallic salts of the overbased detergents (typically metallic carbonates), had a detrimental effect on the neutralization capacity of the cylinder lubricants.

In standard 40 BN cylinder lubricants, formulated for use with low-sulphur fuel oils, the BN provided by the insoluble metallic salts is typically in the order of 30 mg of potash per gram of lubricant.

Thanks to the alternative BN provided by the fatty amines, which do not form hard metallic deposits leading to wear of the parts, in combination with overbased and optionally neutral detergents, the cylinder lubricants according to the present invention are suitable both for high-sulphur fuel oils and for low-sulphur fuel oils.

In an embodiment of the invention, the alternative BN provided by the oil-soluble fatty amines represents at least 15%, preferably at least 30%, preferably at least 50% of the BN of said cylinder lubricant. Or even, in particular for formulae with a BN in the order of 55, the BN provided by the oil-soluble fatty amines represents at least 55%, or at least 60%, or at least 70% of the BN of said cylinder lubricant.

Preferably, the present invention proposes a cylinder lubricant having a BN determined according to standard ASTM D-2896 comprised between 40 and 80 milligrams of potash per gram of lubricant, preferably between 65 and 75, or more preferably equal to 70 milligrams of potash per gram of lubricant.

According to another embodiment, the BN of the lubricants according to the present invention, determined according to standard ASTM D-2896, is comprised between 45 and 60 milligrams of potash per gram of lubricant, preferably between 45 and 55, or more preferably equal to 50 milligrams of potash per gram of lubricant.

According to another embodiment, the BN of the lubricants according to the present invention, determined according to standard ASTM D-2896, is comprised between 54 and 60 milligrams of potash per gram of lubricant, preferably equal to 57, or also preferably equal to 55 milligrams of potash per gram of lubricant.

According to another embodiment, the BN of the lubricants according to the present invention, determined according to standard ASTM D-2896, is comprised between 40 and 50 milligrams of potash per gram of lubricant, preferably equal to 45 milligrams of potash per gram of lubricant.

According to an embodiment, for reasons of cost and availability, the oil-soluble fatty amine(s) and derivatives thereof are obtained from palm, olive, peanut, standard or oleic rapeseed, standard or oleic sunflower, soya or cotton oil, from beef tallow, or from palmitic, stearic, oleic or linoleic acid.

According to an embodiment, the fatty amines are chosen from the amines obtained from fatty acids comprising between 16 and 18 carbon atoms.

In order to avoid the gelling phenomenon sometimes observed with a high content by mass of fatty amines in the lubricant, it is preferable to work with fatty amines comprising between 12 and 24 carbon atoms, preferably between 16 and 22 carbon atoms.

According to an embodiment, the fatty amines are mono- or polyamines, preferably diamines, and the fatty amine derivatives are mono- or polyamine derivatives, preferably diamine derivatives.

In a preferred embodiment, these are polyamines corresponding to the general formula $R—[NH(CH_2)_3]_n—NH_2$, where n is an integer comprised between 1 and 3, and R represents the fatty chain of saturated or unsaturated fatty acids comprising at least 16 carbon atoms, preferably the fatty chain of oleic acid, and the fatty amine derivatives are derivatives of these same diamines.

The diamines corresponding to the general formula $R—NH(CH_2)_3NH_2$, are in particular preferred, where R represents the fatty chain of saturated or unsaturated fatty acids comprising at least 16 carbon atoms, preferably the fatty chain of oleic acid, and where the fatty amine derivatives are derivatives of the same diamines thereof.

The fatty amine derivatives according to the present invention are for example the derivatives of the amines described above. These derivatives are for example chosen from the ethoxylated amines having 1 to 5 ethylene oxide moieties and oxyamines.

In the lubricants according to the present invention, the overbased and/or neutral detergents are preferably chosen from carboxylates, sulphonates, salicylates, naphthenates, phenates, and mixed detergents combining at least two of these types of detergents.

Preferentially, these are compounds based on metals chosen from the group made up of calcium, magnesium, sodium or barium, preferably calcium or magnesium.

They are overbased with insoluble metallic salts chosen from the group of alkali-metal and alkaline-earth carbonates, preferably calcium carbonate.

These detergents provide the additional BN not provided by the oil-soluble fatty amines and derivatives thereof in the cylinder lubricants according to the invention.

According to a preferred embodiment, the percentage by mass of overbased detergents relative to the total weight of lubricant is chosen such that the BN provided by the metallic carbonate salts represents a contribution of at least 5 milligrams of potash per gram of lubricant, preferably at least 10 milligrams of potash per gram of lubricant to the total BN of said cylinder lubricant.

According to a particularly preferred embodiment, the percentage by mass of overbased, and optionally neutral, detergents relative to the total weight of lubricant, is chosen such that the organic BN, provided by the metallic soap detergents represents a contribution of at least 5 milligrams of potash per gram of lubricant, preferably at least 10 milligrams of potash per gram of lubricant, in the cylinder lubricants according to the present invention.

Preferably, the lubricant according to the invention comprises 50 to 90% by weight of base oil, 4 to 30% by weight of at least one detergent based on alkali or alkaline-earth metals overbased with metallic carbonate salts, optionally in combination with one or more neutral detergents, and 2 to 40% by weight of one or more fatty amines and/or fatty amine derivatives as described above.

The lubricants according to the invention can contain one or more functional additives chosen from the dispersant, anti-wear, anti-foam, anti-oxidant and/or anti-rust additives.

For example, they can contain 0.01% to 6%, preferably 0.1% to 4% by mass of one or more anti-wear additives.

They can also contain 0.1% to 4%, preferably 0.4% to 2% by mass of a dispersant additive.

The cylinder lubricants according to the invention preferably have a kinematic viscosity at 100° C. comprised between 12.5 and 26.1 cSt (grades SAE 40, 50, 60), preferably comprised between 16.3 and 21.9 cSt (grade SAE 50).

According to a particularly preferred embodiment, the cylinder lubricants according to the invention have a kinematic viscosity at 100° C. comprised between 18 and 21.5 cSt, preferably between 19 and 21.5 cSt.

Preferentially, the cylinder lubricants according to the invention contain 60% to 90% relative to the total weight of lubricant, of a mixture of one or more base oils, belonging to Groups 1 to 5 defined according to the API nomenclature, preferably to Groups 1 or 2 according to this same nomenclature.

This mixture of base oils can contain 10 to 25% by weight, relative to the total weight of lubricant, of a Group 1 base oil of a BSS type (distillation residue, with a kinematic viscosity at 100° C. of approximately 30 $mm^2/s$, typically comprised between 28 and 32 $mm^2/s$, and with a density at 15° C. comprised between 895 and 915 kg/m3), and 50 to 70% by weight, relative to the total weight of lubricant, of a Group 1 base oil of a Solvent Neutral type (distillate, with a density at 15° C. comprised between 880 and 900 kg/m3, with a kinematic viscosity at 100° C. of approximately 11 $mm^2/s$ for SN 500, or of approximately 12 $mm^2/s$ for the SN 600).

According to another embodiment, in the cylinder lubricants according to the invention, the base oil(s) is/are partially or totally replaced by one or more thickening and/or VI improving polymers.

According to another object the invention relates to the use of a lubricant as described above as a single cylinder lubricant that can be used with any type of fuel oils the sulphur content of which is less than 4.5%, the sulphur content of which is preferably comprised between 0.5 and 4% m/m.

Preferably, the single cylinder lubricant according to the invention can be used both with fuel oils with a sulphur content of less than 1.5 m/m and with fuel oils with a sulphur content greater than 3% m/m, or even greater than 3.5 m/m.

According to a preferred embodiment, the single cylinder lubricant according to the invention can be used both with fuel oils with a sulphur content of less than 1% m/m and with fuel oils with a sulphur content greater than 3% m/m.

According to another object the invention relates to the use of a lubricant as described above for preventing corrosion and/or reducing the formation of a deposit of insoluble metallic salts in two-stroke marine engines during the combustion of any type of fuel oil the sulphur content of which is less than 4.5 m/m.

According to another object the invention relates to the use of one or more compounds chosen from the oil-soluble fatty amines and derivatives thereof, for example the fatty amines and derivatives thereof described above, in order to provide an alternative BN producing no hard metallic deposits in cylinder lubricants for two-stroke marine diesel engines having a BN, measured by standard ASTM D-2896, greater than or equal to 15, preferably greater than 20, preferably greater than 30, advantageously greater than 40 milligrams of potash per gram of lubricant.

According to another object the invention relates to a method for producing a lubricant as described above in which the fatty amine(s) and/or derivatives thereof are added as separate components of the cylinder lubricant having a BN determined according to standard ASTM D-2896 greater than or equal to 15, preferably greater than 20, preferably greater than 30, advantageously greater than 40 milligrams of potash per gram of lubricant and optionally comprising one or more functional additives.

According to an embodiment the lubricant is prepared by dilution of one or more concentrates of marine lubricant additives in which the fatty amine(s) and/or derivatives thereof are incorporated.

According to another object the invention relates to a concentrate of additives for the preparation of cylinder lubricant having a BN determined according to standard ASTM D-2896 greater than or equal to 15, preferably greater than 20, preferably greater than 30, advantageously greater than 40 milligrams of potash per gram of lubricant, said concentrate having a BN comprised between 250 and 300, and comprising one or more fatty amines and/or fatty amine derivatives with a BN comprised between 150 and 600 mg of potash/g of amine according to standard ASTM D-2896, the percentage by mass of said fatty amines and/or derivatives in the concentrate being chosen so as to provide said concentrate with a BN contribution determined according to standard ASTM D-2896 comprised between 35 and 270 milligrams of potash per gram of concentrate.

DETAILED DESCRIPTION OF THE INVENTION

The Fatty Amines and Derivatives Thereof as an Alternative Source of BN to the Overbased Detergents:

The fatty amines used in the lubricants according to the present invention are primary, secondary or tertiary monoamines, or polyamines comprising one or more aliphatic chains, or derivatives thereof.

These compounds have an intrinsic basicity making it possible for them to be used as a significant source of BN in cylinder lubricants, as a substitute for detergents, in particular overbased detergents. The intrinsic BN of the fatty amines and derivatives used in the present invention, measured according to standard ASTM D-2896, is typically comprised between 150 and 600 milligrams of potash per gram, preferably comprised between 200 and 500 milligrams of potash per gram.

These are cationic-type surfactants the polar head of which is made up of the nitrogen atom, (and optionally by one or more oxygen atoms in the case of oxyamine type derivatives and ethoxylated amines) and the lipophilic part is made up of the aliphatic chain(s).

The fatty amines are mainly obtained from carboxylic acids. These acids are dehydrated in the presence of ammonia in order to produce nitriles, which are then subjected to catalytic hydrogenation in order to produce primary, secondary or tertiary amines.

The starting fatty acids for obtaining fatty amines are for example caprylic, pelargonic, capric, undecylenic, lauric, tridecylenic, myristic, pentadecylic, palmitic, margaric, stearic, nonadecylic, arachic, heneicosanoic, behenic, tricosanoic, lignoceric, pentacosanoic, cerotic, heptacosanoic, montanic, nonacosanoic, melissic, hentriacontanoic or laceroic acids or unsaturated fatty acids such as palmitoleic, oleic, erucic, nervonic, linoleic, a-linolenic, c-linolenic, dihomo-c-linolenic, arachidonic, eicosapentaenoic or docosahexanoic acid.

The preferred fatty acids result from the hydrolysis of the triglycerides present in vegetable and animal oils, such as coprah, palm, olive, peanut, rapeseed, sunflower, soya, cotton or linseed oil, beef tallow, etc.; natural oils may have been genetically modified so as to enrich their content of certain fatty acids, for example oleic rapeseed or sunflower oil.

The fatty amines used in the lubricants according to the invention are preferably obtained from natural vegetable or animal resources. The treatments making it possible to obtain fatty amines from natural oils can result in mixtures of primary, secondary and tertiary monoamines and of polyamines.

It is possible for example to incorporate in the lubricants according to the present invention, products containing, in variable proportions, all or some of the compounds corresponding to the following formulae:

$$RNH2,$$

$$R—NH—R$$

$$R—NHCH_2—R$$

$$R—[NH(CH_2)_3]_2—NH_2$$

$$R—[NH(CH_2)_3]_n—NH_2$$

where n is an integer greater than or equal to 1 and R is a fatty chain originating from the fatty acid(s) present in the starting oil. The same fatty mono- or polyamines can also contain several fatty chains originating from different fatty acids.

These products can also be used in purified form, containing mostly a single type of amines, for example mostly diamines.

A product made up of diamines with the formula R—[NH$(CH_2)_3]_2$—$NH_2$, will thus advantageously be used, where R can represent a plurality of fatty acids originating from a natural resource, for example tallow fat.

It is also possible to use purified products. For example, amines obtained from oleic acid are advantageously used, in particular diamines with the formula R—[NH$(CH_2)_3]_2$—$NH_2$ where R is the fatty chain of the oleic acid.

The amines according to the present invention are soluble in the oil matrix to ease their incorporation into the lubricant and be able more easily to reach the droplets of acid to be neutralized, which are dispersed in said oil matrix, in order to be more effective. Thus, the fatty amines of the lubricants according to the present invention are not in the form of an emulsion or microemulsion, but well dispersed in the oil matrix.

The fatty amines according to the present invention are therefore preferably those that comprise at least one aliphatic chain made up of at least 16 carbon atoms, preferably at least 18 carbon atoms.

In order to avoid the gelling phenomenon sometimes observed with a high content by mass of fatty amines in the lubricant, in particular the fatty amines comprising between 12 and 24 carbon atoms, preferably between 16 and 22 carbon atoms are preferred.

The BN of the amines according to the invention being comprised between 150 and 600, and the minimum number of BN points provided by these amines being 10 milligrams of potash per gram of lubricant, leads to their use with minimum contents in the order of 2% by mass in the lubricant, which can however rise in a standard fashion to values in the order of 20% by mass, for example providing 40 BN points with a 200 BN amine or above.

Derivatives of Fatty Amines:

In the lubricants according to the present invention, the alternative BN to the overbased detergents can be provided by fatty amine derivatives. These derivatives are for example ethoxylated amines, obtained by condensation of ethylene oxide with primary or secondary amines, aminoxides, resulting from the reaction of tertiary fatty amines with oxygenated water, or quaternary ammonium salts synthesized from tertiary amines BN of the Lubricants According to the Present Invention.

The BN of the lubricants according to the present invention is provided by the neutral or overbased detergents based on alkali or alkaline-earth metals and by one or more fatty amines and/or derivatives thereof.

The value of this BN, measured according to ASTM D-2896, can vary from 5 to 100 mg KOH/g, or above. A lubricant with a fixed BN value is chosen as a function of the conditions of use of said lubricants and in particular according to the sulphur content of the fuel oil used and in association with the cylinder lubricants.

The lubricants according to the present invention are suitable for use as cylinder lubricants, whatever the sulphur content of the fuel oil used as fuel in the engine.

Therefore the cylinder lubricants for two-stroke marine engines according to the invention have a BN greater than or equal to 15, preferably greater than 20, preferably greater than 30, advantageously greater than 40, preferably comprised between 40 and 80.

According to a preferred embodiment of the invention, the lubricant formulation has a BN level, measured according to standard ASTM D-2896, suitable for use with high-sulphur fuel oils containing in the order of 4.5% m/m) sulphur, i.e. a BN comprised between 65 and 75, or even equal to 70.

According to another embodiment, the BN of the lubricants according to the present invention is comprised between 45 and 60, preferably between 45 and 55, or even equal to 50.

According to an embodiment, the BN of the lubricants according to the present invention is comprised between 55 and 60, or even equal to 57, or even equal to 55.

The share of BN provided by the fatty amines and derivatives is at least 10 points in the lubricants according to the present invention, preferably at least 20 points, preferably at least 30 points, still more preferably at least 40 points. The share of BN provided by a fatty amine in the lubricant (in milligrams of potash per gram of finished lubricant, or BN "points") is calculated from its intrinsic BN measured according to standard ASTM D-2896 and its percentage by mass in the finished lubricant:

$$BN_{amine\ lub}=x\cdot BN_{amine}/100$$

$BN_{amine\ lub}$=contribution of the amine to the BN of the finished lubricant x=% by mass of amine in the finished lubricant $BN_{amine}$=intrinsic BN of the amine alone (ASTM D 28-96).

Thus, for a 70 BN lubricant according to the invention, the fatty amines and derivatives provide a minimum of 14% of the BN. For a 55 BN lubricant according to the invention, the fatty amines and derivatives provide a minimum of 18% of the BN. For a 40 BN lubricant according to the invention, the fatty amines and derivatives provide a minimum of 25% of the BN.

As these fatty amines and derivatives thereof themselves have a BN comprised between 100 and 600, preferably between 200 and 400, the percentage by mass of these compounds in the lubricants according to the present invention is greater than 1.7% (provision of 10 BN points with a 600 BN amine), generally greater than 2%.

The fatty amines do not however provide the entire BN in the lubricants according to the present invention. The Applicant found that the incorporation of fatty amines with a high content led to a significant reduction in viscosity, such that beyond a maximum percentage of fatty amines, it is no longer possible to formulate lubricants having the viscosity grade required for use as cylinder lubricant, unless extremely large quantities of thickening additives are incorporated, which would lead to unrealistic formulae from an economic point of view and would be detrimental to other properties of the lubricant.

The incorporation of amines with a high content may also give rise to toxicity problems.

In order to formulate lubricants suitable for both high and low sulphur contents, it will typically be chosen to work with a BN in the order of 55, or 57, or 70, at least 10 BN points being provided by overbased detergents. Thus at most 60 BN points will generally be provided by the fatty amines, corresponding to a maximum percentage by mass of fatty amines in the order of 10, 15, 30 or 40%, for 600, 400, 200 or 150 BN amines respectively.

Surprisingly, the Applicant also found that the lubricants combining a contribution of BN by amines and by overbased detergents only exhibited satisfactory neutralization efficiency (i.e. in the order of 100 or above) up to a maximum BN level provided by the metallic carbonate salts of the overbased detergents.

Without wishing to be bound by any theory, it seems that these metallic carbonates, which constitute the final reserve of basicity for use of the cylinder lubricant with high sulphur contents, had slower kinetics of neutralization of the sulphuric acid than the metallic soaps and the amines.

Thus, the share of BN provided by the metallic carbonate salts originating from the overbased detergents is at most 20 points (20 milligrams of potash per gram of lubricant) in the lubricants according to the present invention. This BN share, hereafter designated "carbonate BN" or "CaCo3 BN" is measured according to the method described in Example 1 below.

Conventional oils with a BN greater than or equal to 40, thus reformulated according to the invention by substituting fatty amines for the overbased detergents, in such a way that they provide at least 10 BN points in the lubricant, preferably at least 30 BN points in the lubricant, make it possible to adequately prevent problems of corrosion when high-sulphur fuel oils (in the order of 4.5% m/m) are used.

They also allow for a reduction in the formation of deposits of insoluble metallic salts providing the overbasing (for example $CaCO_3$) when low-sulphur fuel oils (1.5% m/m and less) are used. This reduction is directly linked to the reduction in the content of overbased detergents made possible in the present formulation configuration.

Thus, the lubricants according to the present invention, and in particular those with a BN comprised between 65 and 75, for example 70 BN, can be used with both high- and low-sulphur fuel oils.

Overbased or Non-Overbased Detergents.

The detergents used in the lubricating compositions according to the present invention are well known to a person skilled in the art.

The detergents commonly used in the formulation of lubricating compositions are typically anionic compounds comprising a long lipophilic hydrocarbon chain and a hydrophilic head. The associated cation is typically a metallic cation of an alkali or alkaline-earth metal.

The detergents are preferably chosen from the alkali or alkaline-earth metal salts of carboxylic acids, sulphonates, salicylates, naphthenates, as well as the salts of phenates.

The alkali and alkaline-earth metals are preferably calcium, magnesium, sodium or barium.

These metallic salts can contain the metal in an approximately stoichiometric quantity. In this case, the detergents are described as non-overbased or "neutral", although they still provide a certain basicity. These "neutral" detergents typically have a BN, measured according to ASTM D2896, less than 150 mg KOH/g, or less than 100, or even less than 80 mg KOH/g.

This type of so-called neutral detergents can partly contribute to the BN of the lubricants according to the present invention. For example neutral detergents such as carboxylates, sulphonates, salicylates, phenates, naphthenates of alkali and alkaline-earth metals, for example calcium, sodium, magnesium, or barium will be used.

When the metal is in excess (in a quantity greater than the stoichiometric quantity), we are dealing with so-called overbased detergents. Their BN is high, greater than 150 mg KOH/g, typically comprised between 200 and 700 mg KOH/g, generally comprised between 250 and 450 mg KOH/g.

The metal in excess providing the overbased character of the detergent is presented in the form of metallic salts that are insoluble in oil, for example carbonate, hydroxide, oxalate, acetate, glutamate, preferably carbonate.

In the same overbased detergent, the metals of these insoluble salts can be the same as or different from those of the oil-soluble detergents. They are preferably chosen from calcium, magnesium, sodium or barium.

The overbased detergents are thus presented in the form of micelles composed of insoluble metallic salts maintained in suspension in the lubricating composition by the detergents in the form of oil-soluble metallic salts.

These micelles can contain one or more types of insoluble metallic salts, stabilized by one or more detergent types.

The overbased detergents comprising a single type of soluble detergent metallic salt are generally named according to the nature of the hydrophobic chain of the latter detergent.

Thus, they are said to be of phenate, salicylate, sulphonate or naphthenate type according to whether this detergent is a phenate, salicylate, sulphonate, or naphthenate respectively.

The overbased detergents are said to be of mixed type if the micelles comprise several types of detergents, differing from each other by the nature of their hydrophobic chain.

For use in the lubricating compositions according to the present invention, the oil-soluble metallic salts are preferably phenates, sulphonates, salicylates, and mixed phenate-sulphonate detergents and/or calcium, magnesium, sodium or barium salicylates.

The insoluble metal salts providing the overbased character are alkali and alkaline-earth metal carbonates, preferably calcium carbonate.

The overbased detergents used in the lubricating compositions according to the present invention are preferably phenates, sulphonates, salicylates and mixed phenate-sulphonate-salicylate detergents, overbased with calcium carbonate.

BN Provided by the Detergents in the Lubricants According to the Invention:

In the lubricants according to the present invention, a part of the BN is provided by the insoluble metallic salts of the overbased detergents, in particular the metallic carbonates.

The percentage by mass of overbased detergents relative to the total weight of lubricant is thus chosen such that the BN provided by the metallic carbonate salts represents a contribution of at most 20 milligrams of potash per gram of lubricant to the total BN of said cylinder lubricant.

The BN provided by the metallic carbonate salts is measured on the overbased detergent alone and/or on the final lubricant according to the method described in Example 1. Typically in an overbased detergent, the BN provided by the metallic carbonate salts represents 50 to 95% of the total BN of the overbased detergent alone.

These insoluble metallic salts moreover have a favourable anti-wear effect if they are maintained dispersed in the lubricant in the form of stable micelles, which is not the case when they are found in excess in relation to the quantity of sulphuric acid to be neutralized during operation.

Thus, according to a preferred embodiment of the invention, the insoluble metallic salts of the overbased detergents provide at least 5 milligrams of potash per gram of lubricant (or 5 "BN points") in the lubricants according to the present invention, preferably at least 10 BN points.

Moreover, the actual detergents, which are metallic soaps of the essentially phenate or salicylate, or sulphonate type, also contribute to the BN of the lubricants according to the present invention. This BN contribution, hereafter referred to as "organic BN", comes from both the neutral and overbased detergents.

These metallic soaps for their part have a positive effect on the thermal behaviour of the cylinder lubricants. Thus, preferably, the lubricants according to the present invention have a certain part of their BN provided by these metallic soaps.

According to a preferred embodiment, the organic BN provided by the metallic soaps represents a contribution of at least 5 milligrams of potash per gram of lubricant, preferably at least 10 milligrams of potash per gram of lubricant, in the cylinder lubricants according to the present invention.

The BN of the lubricants according to the present invention, measured according to ASTM D2896 therefore comprises at least 3 separate components:

- the BN provided by the fatty amines, determined as a function of the BN of the amines measured according to ASTM 2896 and the percentage by mass of fatty amines.
- The BN provided by the insoluble metallic salts of the overbased detergents, called by extension "carbonate BN" or "CaCO3 BN", and measured using the method described in Example 1 hereafter.
- The "organic" BN provided by the metallic soaps of the overbased and optionally neutral detergents, and obtained by the difference between the total BN of the lubricant and the other contributions.

The Base Oils.

In general, the base oils used for the formulation of lubricants according to the present invention can be oils of mineral, synthetic or vegetable origin as well as mixtures thereof.

The mineral or synthetic oils generally used in the application belong to one of the classes defined in the API classification as summarized in the table below.

| | Saturates content | Sulphur content | Viscosity index |
|---|---|---|---|
| Group 1 Mineral oils | <90% | >0.03% | 80 ≦ VI < 120 |
| Group 2 Hydrocracked oils | ≧90% | ≦0.03% | 80 ≦ VI < 120 |
| Group 3 Hydro-isomerized oils | ≧90% | ≦0.03% | ≧120 |
| Group 4 | PAO | | |
| Group 5 | Other bases not included in base groups 1 to 4 | | |

The mineral oils in Group 1 can be obtained by distillation of selected naphthenic or paraffinic crude oils then purification of these distillates by processes such as solvent extraction, solvent or catalytic dewaxing, hydrotreating or hydrogenation.

The oils in Groups 2 and 3 are obtained by more severe purification processes, for example a combination of hydrotreating, hydrocracking, hydrogenation and catalytic dewaxing.

Examples of synthetic bases in Groups 4 and 5 include the poly-alpha olefins, polybutenes, polyisobutenes and alkylbenzenes.

These base oils can be used alone or in a mixture. A mineral oil can be combined with a synthetic oil.

Cylinder oils for 2-stroke marine diesel engines have a viscosimetric grade of SAE-40 to SAE-60, generally SAE-50 equivalent to a kinematic viscosity at 100° C. comprised between 16.3 and 21.9 $mm^2/s$.

Grade 40 oils have a kinematic viscosity at 100° C. comprised between 12.5 and 16.3 cSt.

Grade 50 oils have a kinematic viscosity at 100° C. comprised between 16.3 and 21.9 cSt.

Grade 60 oils have a kinematic viscosity at 100° C. comprised between 21.9 and 26.1 cSt.

According to industry practice, it is preferred to formulate cylinder oils for 2-stroke marine diesel engines having a kinematic viscosity at 100° C. comprised between 18 and 21.5, preferably between 19 and 21.5 mm2/s (Cst).

This viscosity can be obtained by a mixture of additives and base oils for example containing Group 1 mineral bases such as Solvent Neutral bases (for example SN 500 or SN 600) and bright stock. Any other combination of mineral or synthetic bases or bases of vegetable origin having, in mixture with the additives, a viscosity compatible with the grade SAE 50 can be used.

Typically, a standard formulation of cylinder lubricant for low-speed 2-stroke marine diesel engines is of grade SAE 40 to SAE 60, preferably SAE 50 (according to the SAE J300 classification) and comprises at least 50% by weight of lubricating base oil of mineral and/or synthetic origin, suitable for use in marine engines, for example, of class API Group 1, i.e. obtained by distillation of selected crude oils then purification of these distillates by processes such as solvent extraction, solvent or catalytic dewaxing, hydrotreating or hydrogenation. Their Viscosity Index (VI) is between 80 and 120; their sulphur content is greater than 0.03% and their saturated content less than 90%.

Typically, a standard formulation of cylinder lubricant for low-speed 2-stroke marine diesel engines contains 18 to 25% by weight, relative to the total weight of lubricant, of a Group 1 base oil of a BSS type (distillation residue, with a kinematic viscosity at 100° C. of approximately 30 $mm^2/s$, typically comprised between 28 and 32 $mm^2/s$, and with a density at 15° C. comprised between 895 and 915 kg/m3), and 50 to 60% by weight, relative to the total weight of lubricant, of a Group 1 base oil of a SN 600 type (distillate, with a density at 15° C. comprised between 880 and 900 kg/m3, with a kinematic viscosity at 100° C. of approximately 12 $mm^2/s$).

Thickening Additives:

In the lubricants according to the present invention, the Applicant has demonstrated that the introduction of significant quantities of fatty amines (typically in the order of 5 to 15%, or greater than 10%, or even in the order of 20% by mass) has the effect of reducing the viscosity of the lubricant. Thus, it may be necessary, in particular for higher amine contents, to introduce into the lubricants according to the present invention thickening and/or viscosity index improving polymers having the effect of increasing the viscosity of the lubricant. This makes it possible to formulate cylinder lubricants of a viscosimetric grade suited to their use.

Thus, according to an embodiment, in the cylinder lubricants according to the invention, the base oil(s) is/are partially or totally replaced by one or more thickening additives the role of which is to increase the viscosity of the composition, when warm as well as cold, or by viscosity index (VI) improving additives.

These additives are most often low molecular weight polymers, in the order of 2000 to 50,000 dalton (Mn).

They can be chosen from the PIBs (in the order of 2,000 dalton), polyacrylate or polymethacrylates (in the order of 30,000 dalton), olefin-copolymers, olefin and alpha-olefin copolymers, EPDM, polybutenes, high molecular weight polyalphaolefins (viscosity 100° C.>150) or styrene-olefin copolymers, hydrogenated or non-hydrogenated.

In the cylinder lubricants according to the invention, the polymers used to partially or totally replace one or more of the base oils are preferably abovementioned thickeners of a PIB type (for example marketed under the name of Indopol H2100).

They are preferably present at a level of 5 to 20% by weight in the cylinder lubricants according to the invention, preferably between 8 and 20% in the case of amine contents greater than 15% by mass.

Anti-Wear Additives:

The lubricants according to the present invention contain, at an equivalent BN, a smaller quantity of overbased detergents than that present in standard cylinder lubricants. Thus, a 70 BN cylinder lubricant usually contains in the order of 25% by mass of overbased detergents, whereas in the 70 BN lubricants of the invention, this content can drop to approximately 15% or even be lower than 5%.

As mentioned above, these compounds can have a positive anti-wear effect. This is why the cylinder lubricants according to the invention will preferably comprise anti-wear additives.

Anti-wear additives protect friction surfaces by forming a protective film adsorbed on these surfaces. The most commonly used is zinc dithiophosphate or DTPZn. Various phosphorus-, sulphur-, nitrogen-, chlorine- and boron-containing compounds are also found in this category.

A great variety of anti-wear additives exists, but the most frequently used category is that of the phospho sulphur-containing additives such as metallic alkylthiophosphates, in particular zinc alkylthiophosphates, and more specifically zinc dialkyldithiophosphates or DTPZn. The preferred compounds have the formula Zn((SP(S)(OR1)(OR2))2, where R1 and R2 are alkyl groups, preferably comprising 1 to 18 carbon atoms. DTPZn is typically present at levels in the order of 0.1 to 2% by weight.

Amine phosphates and polysulphides, in particular the sulphur-containing olefins, are also commonly used anti-wear additives.

Anti-wear and extreme-pressure additives of a nitrogen- and sulphur-containing type, such as for example metallic dithiocarbamates, in particular molybdenum dithiocarbamate are also usually encountered in the lubricating compositions. Glycerol esters are also anti-wear additives. For example mono-, di- and trioleates, monopalmitates and monomyristates can be mentioned.

The anti-wear and extreme-pressure additives are present in the compositions for lubricants at levels comprised between 0.01 and 6%, preferably comprised between 0.1 and 4%.

According to a preferred embodiment, the cylinder lubricants according to the present invention contain at least 0.5% by mass of one or more anti-wear additives.

The preferred anti-wear additives are of a DTPZn type.

Dispersant Additives.

Dispersants are well-known additives used in the formulation of lubricating compositions, in particular for application in the marine field. Their primary role is to maintain in suspension the particles initially present or appearing in the lubricating composition during its use in the engine. They prevent their agglomeration by acting on the steric hindrance. They can also have a synergistic effect on neutralization.

The dispersants used as lubricant additives typically contain a polar group, associated with a relatively long hydrocarbon chain, generally containing 50 to 400 carbon atoms. The polar group typically contains at least one nitrogen, oxygen or phosphorus element.

Compounds derived from succinic acid are dispersants particularly used as lubrication additives. In particular succinimides, obtained by condensation of succinic anhydrides and amines, and succinic esters obtained by condensation of succinic anhydrides and alcohols or polyols are used.

These compounds can then be treated with various compounds in particular sulphur, oxygen, formaldehyde, carboxylic acids and compounds containing boron or zinc in order to produce for example borated succinimides or zinc-blocked succinimides.

Mannich bases, obtained by polycondensation of phenols replaced by alkyl groups, formaldehyde and primary or secondary amines, are also compounds used as dispersants in lubricants.

According to an embodiment of the present invention, at least 0.1% of a dispersant additive is used. A dispersant from the family of PIB succinimides, for example borated or zinc-blocked, can be used.

Other Functional Additives.

The lubricant formulation according to the present invention can also contain any functional additives appropriate to their use, for example anti-foam additives to counter the effect of the detergents, which can be for example polar polymers such as polymethylsiloxanes, polyacrylates, anti-oxidant and/or anti-rust additives, for example organo-metallic detergents or thiadiazoles. The latter are known to a person skilled in the art. These additives are generally present in a content by weight of 0.1 to 5%.

According to the present invention, the compositions of the lubricants described refer to the compounds taken separately before mixture, it being understood that said compounds may or may not retain the same chemical form before and after mixture. Preferably, the lubricants according to the present invention obtained by mixture of the compounds taken separately are not in the form of an emulsion or microemulsion.

Concentrates of Additives for Marine Lubricants:

The fatty amines and derivatives contained in the lubricants according to the present invention can in particular be incorporated into a lubricant as separate additives. However, the fatty amines and derivatives contained in the lubricants according to the present invention can also be integrated in an additive concentrate for a marine lubricant.

The standard additive concentrates for marine cylinder lubricant are generally made up of a mixture of the components described above, detergents, dispersants, other functional additives, pre-dilution base oil, in proportions making it possible to obtain, after dilution in a base oil, cylinder lubricants having a BN determined according to standard ASTM D-2896 greater than or equal to 15, preferably greater than 20, preferably greater than 30, advantageously greater than 40 milligrams of potash per gram of lubricant. This mixture generally contains, relative to the total weight of concentrate, a detergent content greater than 80%, preferably greater than 90%, a dispersant additive content of 2 to 15%, preferably 5 to 10%, a content of other functional additives of 0 to 5%, preferably 0.1 to 1%. The BN of said concentrates, measured according to ASTM D 2896, is generally comprised between 250 and 300 milligrams of potash per gram of concentrate, typically in the order of 275 milligrams of potash per gram of concentrate.

According to one object, the invention relates to a concentrate of additives for the preparation of cylinder lubricant having a BN determined according to standard ASTM D-2896 greater than or equal to 15, preferably greater than 20, preferably greater than 30, advantageously greater than 40 milligrams of potash per gram of lubricant, said concentrate having a BN comprised between 250 and 300, and comprising one or more fatty amines and/or fatty amine derivatives with a BN comprised between 150 and 600 mg of potash/g of amine according to standard ASTM D-2896, the percentage by mass of said fatty amines and/or derivatives in the concentrate being chosen so as to provide said concentrate with a BN contribution determined according to standard ASTM D-2896 comprised between 35 (14% of 250) and 270 (90% of 300) milligrams of potash per gram of concentrate.

According to another embodiment, the percentage by mass of said fatty amines and/or derivatives in the concentrate is chosen so as to provide said concentrate with a BN contribution determined according to standard ASTM D-2896 comprised between 60 (25% of 250) and 225 (75% of 300) milligrams of potash per gram of concentrate.

According to another embodiment, the percentage by mass of said fatty amines and/or derivatives in the concentrate is chosen so as to provide said concentrate with a BN contribution determined according to standard ASTM D-2896 comprised between 135 (55% of 250) and 225 (75% of 300) milligrams of potash per gram of concentrate.

The fatty amines in the concentrates according to the invention are those described above and in the examples hereafter as an alternative source of BN to the detergents.

The concentrates according to the invention also contain a small quantity of base oil, but sufficient to facilitate the utilization of said additive concentrates.

Measurement of the Performance Differential Between a Conventional Reference Lubricant and a Lubricant According to the Invention.

This measurement is characterized by a neutralization efficiency index measured according to the method of the enthalpy test described in detail in the examples, in which the progress of the exothermic neutralization reaction is monitored by the rise in temperature observed when said lubricant containing the basic sites is brought into the presence of sulphuric acid.

Of course the present invention is not limited to the examples and embodiment described and shown, but is capable of numerous variants accessible to a person skilled in the art.

EXAMPLES

Example 1

This example aims to describe the method making it possible to measure the contribution of the insoluble metallic salts present in the overbased detergents to the BN of the lubricating compositions containing said overbased detergents:

The total basicity measurement (referred to as BN or Base Number) of the finished lubricating oils or overbased detergents is carried out using the ASTM D2896 method. The BN is composed of two distinct forms:

- carbonate BN, provided by the overbasing of the detergent with metallic carbonates, generally calcium carbonate, hereafter referred to as "$BN_{CaCO3}$",
- so-called organic BN provided by the metallic soap of the detergent of an essentially phenate or salicylate type, or sulphonate.

The carbonate BN, hereafter referred to as "$BN_{CaCO3}$" is measured on the finished oil or the overbased detergents alone, according to the following procedure. The latter is based on the principle of attacking the (calcium) carbonate overbasing of the sample with sulphuric acid. This carbonate is converted to carbonic gas according to the reaction;

$$CaCO_3 + H_2SO_4 \longrightarrow CaSO_4 + H_2O + \overrightarrow{CO_2}$$

The volume of the reactor being constant, the pressure increases proportionally as CO2 is released.

Figure 2:
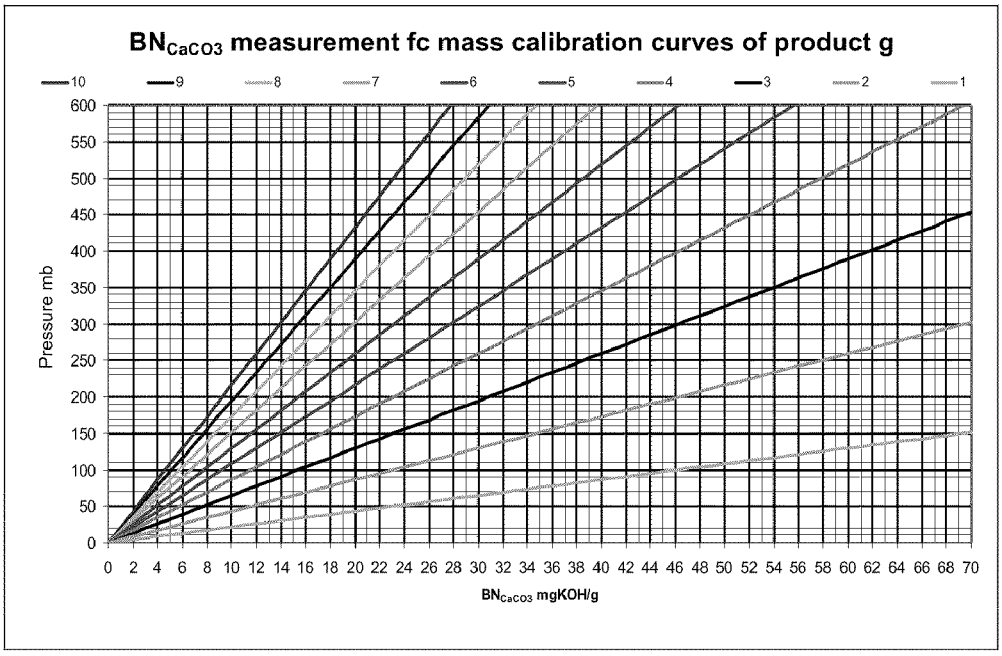

Procedure: in a reaction vessel with a volume of 100 ml, equipped with a stopper on which a differential manometer is fitted, the necessary quantity of product the $BN_{CaCO3}$ of which is to be measured, is weighed so as not to exceed the measurement limit of the differential manometer, which is 600 mb of pressure increase. The quantity is determined from the graph in FIG. 2, indicating for each mass of product (1 to 10 grams, from right to left in the figure) the pressure measured on the differential manometer (which corresponds to the pressure increase due to the release of $CO_2$) as a function of the proportion of $BN_{CaCO3}$ in the sample. If the result of $BN_{CaCO3}$ is unknown, a moderate quantity of product of approximately 4 g is weighed. In all cases, the sample mass is noted (m).

The reaction vessel can be made of pyrex, glass, polycarbonate, etc. or any other material promoting heat exchanges with the ambient medium, such that the internal temperature of the vessel rapidly reaches equilibrium with that of the ambient medium.

A small quantity of fluid base oil, of a SN 600 type, is introduced into the reaction vessel containing a small magnetic bar.

Approximately 2 ml of concentrated sulphuric acid is placed in the reaction vessel, taking care not to stir the medium at this stage.

The stopper and manometer assembly is screwed onto the reaction vessel. The screw threads can be lubricated. Tightening is carried out to ensure a complete seal.

Stirring is commenced, and continued for as long as necessary for the pressure to stabilize, and for the temperature to reach equilibrium with the ambient medium. A period of 30 minutes is sufficient. The pressure increase P and the ambient temperature T° C. (σ) are noted.

The assembly is cleaned with a heptane-type solvent.

Calculation Method

In order to calculate the pressure the perfect gas formula is used.

$$PV=nRT$$

P=Partial pressure of CO2(Pa) (1 Pa=$10^{-2}$ mb)
V=Volume of the container ($m^3$).
R=8.32 (J).
T=273+σ(° C.)=(° K).
n=number of moles of $CO_2$ released $$PCO_2 = \frac{nCO_2 * R * T}{V} * 10^2$$

Calculation of the Number of Moles of $CO_2$.

$$m^{*}\text{carbonate BN}=\text{mg KOH equivalent.}$$

m=mass of product in grams
carbonate BN=BN expressed in KOH per 1 g equivalent.

$$\frac{m * \text{carbonate BN} * \frac{44}{2 * 56.1}}{1000} = \text{g of } CO_2 \text{ released,}$$

i.e. the number of moles of $CO_2$ released:

$$\frac{m * \text{carbonate BN} * 44 * 10^3}{44 * 2 * 56.1} = m * \text{carbonate BN} * 0.0089\ 10^{-3}$$

Formula for Calculating the Pressure of $CO_2$ as a Function of the Carbonate BN.

$$PCO_2 = \frac{m * \text{carbonate BN} * 0.0089\ 10^{-3} * R * T * 10^{-2}}{V}$$

Formula for Calculating the Carbonate BN from the $CO_2$ Pressure.

$$\text{carbonate BN} = \frac{P*V}{m*0.0089*10^{-3}*R*T*10^{-2}}$$

By fixing the values linked to the test conditions, the simplified formula is obtained:

P $CO_2$=value read on the differential manometer, in mbars=P read

V=volume of the container in $m^3$=0.0001.

R=8.32(J).

T=273+σ(° C.)=(° K). σ=Ambient temperature read.

m=mass of product introduced into the reaction vessel.

$$\text{carbonate BN} = \frac{P\ \text{read}*0.0001}{m*0.0089*10^{-3}*8.32*(273*\sigma read)*10^{-2}}$$

$$\text{carbonate BN} = \frac{P\ \text{read}}{m*0.0074*R*(273*\sigma read)}$$

The result obtained is the $BN_{CaCO3}$ expressed in mg KOH/g.

The BN provided by the metallic soaps of detergents, also referred to as "organic BN", is obtained by the difference between the total BN according to ASTM D2896 and the $BN_{CaCO3}$ thus measured.

Example 2

This example aims to describe the enthalpy test making it possible to measure the neutralization efficiency of the lubricants vis-à-vis sulphuric acid.

The availability or accessibility of the basic sites included in a lubricant, in particular a cylinder lubricant for a two-stroke marine engine, vis-à-vis the acid molecules, can be quantified by a dynamic test for monitoring the speed or kinetics of neutralization.

Principle:

The acid-base neutralization reactions are generally exothermic and it is therefore possible to measure the release of heat obtained by reaction of sulphuric acid on the lubricants to be tested. This release is monitored by the evolution of temperature over time in a DEWAR type adiabatic reactor.

Based on these measurements, it is possible to calculate an index quantifying the efficiency of a lubricant according to the present invention compared with a lubricant used as a reference, and for an added quantity of acid representing a fixed number of BN points to be neutralized. The BN of the lubricants to be tested is preferably excessive relative to the BN necessary to neutralize the quantity of acid added. In order to test 70 BN lubricants, in the examples which follow, a quantity of acid corresponding to the neutralization of 55 BN points is added.

The efficiency index is thus calculated relative to the reference oil to which the value of 100 is assigned. This is the ratio between the neutralization reaction times of the reference ($S_{ref}$) and the measured sample ($S_{meas}$):

$$\text{Neutralization efficiency index}=S_{ref}/S_{meas}\times 100$$

The values of these neutralization reaction times, which are in the order of a few seconds, are determined from the acquisition curves of the increase in temperature as a function of time during the neutralization reaction. (See curve in FIG. 1).

The duration S is equal to the difference $t_f-t_i$ between the time at the temperature at the end of the reaction and the time at the temperature at the start of the reaction.

The time $t_i$ at the temperature at the start of the reaction corresponds to the first rise in temperature after stirring is started.

The time $t_f$ at the temperature at the end of the reaction is the time from which the temperature signal remains stable for a period of time greater than or equal to half the reaction time.

The lubricant is all the more efficient as it leads to short neutralization times and therefore a high index.

Equipment Used:

The geometries of the reactor and of the stirrer as well as the operating conditions have been chosen so as to be within the chemical range, where the effect of the diffusional constraints in the oil phase is negligible.

Therefore in the configuration of the equipment used, the depth of fluid must be equal to the internal diameter of the reactor, and the helical stirrer must be positioned approximately ⅓ of the way up the fluid.

The equipment is made up of a 300 ml adiabatic reactor of a cylindrical type, the internal diameter of which is 52 mm and the internal height 185 mm, with a stirring rod equipped with a helix with inclined blades, 22 mm in diameter; the diameter of the blades is comprised between 0.3 and 0.5 times the diameter of the DEWAR flask, i.e. 15.6 to 26 mm.

The position of the helix is fixed at a distance of approximately 15 mm from the base of the reactor. The stirring system is driven by a 10 to 5,000 rpm variable speed motor and a temperature acquisition system as a function of time.

This system is suitable for measuring reaction times in the order of 5 to 20 seconds and for measuring the rise in temperature of a few tens of degrees starting from a temperature of approximately 20° C. to 35° C., preferably approximately 30° C. The position of the temperature acquisition system in the DEWAR flask is fixed.

The stirring system is controlled in such a way that the reaction takes place within a chemical range: in the configuration of the present experiment, the rotation speed is adjusted to 2000 rpm, and the position of the system is fixed.

Moreover, the chemical range of the reaction is also dependent on the depth of oil introduced into the DEWAR flask, which must be equal to the diameter of the flask, and which corresponds in the context of this experiment to a mass of approximately 86 g of the lubricant tested.

In order to test 70 BN lubricants, here the quantity of acid corresponding to the neutralization of 55 BN points is introduced into the reactor.

4.13 g of 95% concentrated sulphuric acid and 85.6 g of lubricant to be tested are introduced into the reactor, for a 70 BN lubricant.

After placing the stirring system inside the reactor so that the acid and the lubricant mix well and in a reproducible manner between two tests, stirring is started in order to monitor the reaction within a chemical range. The acquisition system is permanent.

Implementation of the Enthalpy Test—Calibration:

In order to calculate the efficiency indices of the lubricants according to the present invention using the method described above, we chose to take as a reference the neutralization reaction time measured for a 70 BN two-stroke marine engine cylinder oil (measured according to ASTM D-2896), comprising no fatty amines according to the present invention.

This oil is obtained from a mineral base obtained by mixture of a distillate with a density at 15° C. comprised between 880 and 900 Kg/m$^3$ with a distillation residue with a density comprised between 895 and 915 Kg/m$^3$ (bright stock) in a distillate/residue ratio of 3.

A concentrate containing an overbased calcium sulphonate with a BN equal to 400 mg KOH/g, a dispersant, and an overbased calcium phenate with a BN equal to 250 mg KOH/g is added to this base. This oil is formulated specifically to have a neutralization capacity sufficient to be used with fuels with a high sulphur content, namely S contents greater than 3% or even 3.5%.

The reference lubricant contains 25.50% by mass of this concentrate. Its BN of 70 is provided exclusively by the overbased detergents (overbased phenates and sulphonates) contained in said concentrate.

This reference lubricant has a viscosity at 100° C. comprised between 18 and 21.5 mm$^2$/s.

The neutralization reaction time of this oil (hereafter reference Href) is 10.59 seconds and its neutralization efficiency index is fixed at 100.

Example 3

This example describes by way of comparison the influence of the contribution of the BN provided by the metallic carbonate salts on the performances of the cylinder oils, namely their neutralization efficiency.

In this example several 70 BN cylinder oils A, B, C, are used, in which part of the BN is provided, as in the reference oil, by a concentrate of overbased detergents, and another part is provided by a mixture of fatty polyamines obtained from tallow, containing mainly palmitic, stearic and oleic acids. This amine mixture has a BN of 460 mg KOH/g. It is made up of compounds with the formula $R[NH—(CH_2)_3]_nNH_2$, where R represents the fatty chain of the palmitic, stearic or oleic acids, and n is an integer comprised between 0 and 3.

The reference is the 70 BN two-stroke marine engine cylinder oil referenced Href in the previous example.

Table 1 hereafter summarizes the characteristics of the reference and of the samples tested as well as the values of their efficiency indices.

TABLE 1

| | H ref | A | B | C |
|---|---|---|---|---|
| % by mass composition | | | | |
| Concentrate of overbased phenates + sulphonates | 25.50 | 21.30 | 17.10 | 12.90 |
| Fatty (poly)amines, BN 460 mg KOH/g, ASTM D2896 | 0.00 | 2.50 | 5.00 | 7.50 |
| Gr I base oils | 74.50 | 76.20 | 77.90 | 79.60 |
| Properties | | | | |
| KV 100 (Cst), ASTMD445 | 20.5 | 19.21 | 18.36 | 16.51 |
| KV 40 (Cst), ASTMD445 | 243.7 | 221.1 | 208.3 | 178 |
| total BN (mg KOH/g, ASTM D-2896.) | 70.1 | 71 | 69.4 | 73.4 |
| Of which BN provided by fatty amines (mg KOH/g, ASTM D-2896) | 0 (0% of the BN) | 11.50 (16%) | 23 (33%) | 34.50 (47%) |
| Of which CaCO3 BN (mg KOH/g) | 51.0 (74% of the BN) | 42.6 (60%) | 34.2 (49%) | 25.8 (35%) |
| Neutralization efficiency index (EI) | 100 | 59 | 65 | 76 |

It will be noted that the neutralization efficiency index of the lubricants is considerably less than 100 when the contribution of the BN provided by the metallic carbonate salts is greater than 20 milligrams of potash per gram of lubricant.

Example 4

This example according to the invention describes the influence of the contribution made to the BN by the metallic carbonate salts on the performances of the cylinder oils, namely the neutralization efficiency.

The reference is the 70 BN two-stroke marine engine cylinder oil referenced Href in Example 1.

Oils G to J contain, as an alternative source of BN to the overbased detergents, a compound comprising mostly a fatty diamine obtained from oleic acid, with the formula $RNH(CH_2)_3NH_2$, where R represents the fatty chain of oleic acid. The BN of this compound is 320 mg KOH/g (Dinoram O).

Oils K and L contain, as an alternative source of BN to the overbased detergents, a compound comprising mostly a C16 fatty amine of the dimethyl-hexadecyl-amine kind. The BN of this compound is 200 mg KOH/g (Genamine 16R).

The fatty amines in this example provide approximately 40 BN points out of a total of 70, i.e. approximately 57%. The remainder of the BN is provided by detergents of a neutral phenate, overbased phenate and overbased sulphonate type.

It will be noted that the neutralization efficiency index of the lubricants is greater than 100 when the contribution made to the BN by the metallic carbonate salts is less than 20 milligrams of potash per gram of lubricant.

Moreover, in order to compensate for the reduction in viscosity caused by the introduction of the fatty amines and in order to obtain lubricants that satisfy the requirements for use as two-stroke marine diesel engine cylinder oil, PIB has been introduced into the formulae.

Furthermore, it was noted that oil G exhibited mediocre anti-wear performances (as measured for example in the ASTM D2670 test carried out in the FALEX pin & vee block machine), compared with the reference Href. Efforts were therefore made to compensate for this reduction in wear performance by the addition of an anti-wear additive of a DTPZn type to oils H, I, J, K and L.

This reduction in performance is probably due to the reduction in the content of overbased detergents, which, in the form of stable micelles, have a positive anti-wear effect (conversely, when the micelles are destabilized, for example when the overbased detergents are in excess in relation to the quantity of acid produced during operation, there is formation of hard metallic deposits that cause wear).

The characteristics and performances of the oils thus formulated are summarized in Table 2. Oils H, I, J and K are preferred oils according to the invention, with an efficiency index comparable to or even greater than that of the reference, and a viscosity grade allowing for their use as cylinder lubricant.

TABLE 2

| | H ref | G | H | I | J | K | L |
|---|---|---|---|---|---|---|---|
| % by mass composition | | | | | | | |
| Overbased phenates and/or sulphonates | 25.50 | 4.00 | 4.00 | 4.00 | 11.00 | 4.00 | 4.00 |
| Neutral phenates | | 9.00 | 9.00 | 9.00 | | 9.00 | 9.00 |
| Oleic fatty diamines, BN 320 mg KOH/g, ASTM D2896 | | 12.50 | 12.50 | 12.50 | 12.50 | | |
| Genamine 16 R BN 200 mg KOH/g, ASTM D2896 | | | | | | 20.00 | 20.00 |
| Gr I base oils | 74.50 | 73.45 | 72.95 | 65.00 | 66.00 | 50.55 | 57.50 |
| PIB Indopol H2100 | | | | 7.95 | 8.95 | 14.90 | 7.95 |
| DTPZn | | | 0.50 | 0.50 | 0.50 | 0.50 | 0.50 |
| Dispersant | | 1.05 | 1.05 | 1.05 | 1.05 | 1.05 | 1.05 |
| Properties | | | | | | | |
| KV 100 (Cst), ASTM D445 | 20.52 | 21.89 | 21.47 | 19.56 | 20.16 | 19.83 | 13.40 |
| KV 40 (Cst), ASTM D445 | 243.7 | 250.4 | 251 | 197.29 | 202.50 | 165.54 | 99.80 |
| Total BN (mg KOH/g, ASTM D-2896.) | 70.1 | 70 | 71 | 72 | 70 | 70 | 69.6 |
| Of which BN provided by fatty amines (mg KOH/g, ASTM D-2896) | 0 (0% of the BN) | 40 (57%) | 39.7 (56%) | 39.7 (57%) | 39.7 (57%) | 39.8 (57%) | 39.8 (57%) |
| Of which $CaCO_3$ BN (mg KOH/g) | 51.0 (74% of the BN) | 16.9 (24%) | 16.9 (24%) | 16.9 (23%) | 16.0 (23%) | 16.9 (24%) | 16.9 (24%) |
| Neutralization efficiency index (EI) | 100 | 114 | 120 | 117 | 104 | 101 | 118 |

The invention claimed is:

1. A cylinder lubricant having a BN, determined according to standard ASTM D-2896, greater than or equal to 15 milligrams of potash per gram of lubricant, comprising:

a) one or more lubricating base oils for marine engines, b) at least one overbased detergent, wherein said overbased detergent is an alkali or alkaline-earth metal-based detergent overbased with metallic carbonate salts, optionally in combination with one or more neutral detergents, c) one or more oil-soluble fatty amines and/or fatty amine derivatives, having a BN determined according to standard ASTM D-2896 between 150 and 600 milligrams of potash per gram, the percentage by mass of fatty amines and/or of derivatives thereof relative to the total weight of lubricant being chosen such that the BN provided by these compounds represents a contribution of at least 10 milligrams of potash per gram of lubricant, to the total BN of said cylinder lubricant and, the percentage by mass of overbased detergents relative to the total weight of lubricant being chosen such that the BN provided by the metallic carbonate salts represents a contribution of at most 20 milligrams of potash per gram of lubricant to the total BN of said cylinder lubricant.

2. The cylinder lubricant according to claim 1 in which the percentage by mass of fatty amines and/or of derivatives thereof relative to the total weight of lubricant is chosen such that the BN provided by these compounds represents at least 15%, of the BN of said cylinder lubricant.

3. The cylinder lubricant according to claim 1 having a BN determined according to standard ASTM D-2896 between 40 and 80 milligrams of potash per gram of lubricant.

4. The cylinder lubricant according to claim 1 in which the oil-soluble fatty amine(s) and derivatives thereof are obtained from palm, olive, peanut, standard or oleic rapeseed, standard or oleic sunflower, soya or cotton oil, from beef tallow, or from palmitic, stearic, oleic or linoleic acid.

5. The cylinder lubricant according to claim 1 in which the oil-soluble fatty amine(s) and derivatives thereof are obtained from fatty acids comprising between 16 and 18 carbon atoms.

6. The cylinder lubricant according to claim 1 in which the fatty amines are polyamines corresponding to the general formula $R—[NH(CH_2)_3]_n—NH_2$, where n is an integer between 1 and 3, and R represents the fatty chain of a saturated or unsaturated fatty acid comprising at least 16 carbon atoms, and where the fatty amine derivatives are derivatives of these same polyamines.

7. The cylinder lubricant according to claim 1 in which the fatty amines are diamines corresponding to the general formula $R—NH—(CH_2)_3—NH_2$, where R represents the fatty chain of a saturated or unsaturated fatty acid comprising at least 16 carbon atoms, and where the fatty amine derivatives are derivatives of these same diamines.

8. The cylinder lubricant according to claim 1 in which the fatty amine derivatives are selected from the group consisting of amine oxides and ethoxylated amines having 1 to 5 ethylene oxide moieties.

9. The cylinder lubricant according to claim 1 in which the overbased and/or neutral detergents are selected from the group consisting of carboxylates, sulphonates, salicylates, naphthenates, phenates, and mixed detergents combining at least two of these types of detergents.

10. The cylinder lubricant according to claim 1 in which the overbased and/or neutral detergents are compounds based on metals selected from the group consisting of calcium, magnesium, sodium or barium.

11. The cylinder lubricant according to claim 1 in which the overbased detergents are overbased with insoluble metallic salts selected from the group consisting of alkali and alkaline-earth metal carbonates.

12. The cylinder lubricant according to claim 1 in which the percentage by mass of overbased detergents relative to the total weight of lubricant is chosen such that the BN provided by the metallic carbonate salts represents a contribution of at least 5 milligrams of potash per gram of lubricant to the total BN of said cylinder lubricant.

13. The cylinder lubricant according to claim 1 in which the percentage by mass of overbased, and optionally neutral, detergents relative to the total weight of lubricant, is chosen such that the organic BN provided by the detergent represents a contribution of at least 5 milligrams of potash per gram of lubricant.

14. The cylinder lubricant according to claim 1, the kinematic viscosity of which, measured according to standard ASTM D445 at 100° C., is between 12.5 and 26.1 cSt.

15. A method of preventing corrosion and/or reducing the formation of insoluble metallic salt deposits in two-stroke marine engines during the combustion of fuel oil, the sulphur content of which is less than 4.5% m/m, comprising contacting a cylinder in said two-stroke marine engine with a cylinder lubricant according to claim 1.

16. A concentrate of additives for the preparation of cylinder lubricant having a BN determined according to standard ASTM D-2896 greater than or equal to 15 milligrams of potash per gram of lubricant, said concentrate having a BN between 250 and 300 mg of potash per gram, and comprising one or more fatty amines and/or fatty amine derivatives with a BN between 150 and 600 mg of potash per gram of amine according to standard ASTM D-2896, the percentage by mass of said fatty amines and/or derivatives in the concentrate being chosen so as to provide said concentrate with a BN contribution determined according to standard ASTM D-2896 between 35 and 270 milligrams of potash per gram of concentrate.

17. The cylinder lubricant according to claim 1, wherein the percentage by mass of fatty amines and/or of derivatives thereof relative to the total weight of lubricant is chosen such that the BN provided by fatty amines and/or derivatives thereof represents a contribution of at least 40 milligrams of potash per gram of lubricant.

18. The cylinder lubricant according to claim 1, wherein said one or more oil-soluble fatty amines and/or fatty amine derivatives has a BN determined according to standard ASTM D-2896 between 200 and 500 milligrams of potash per gram.

19. The cylinder lubricant according to claim 2, in which the percentage by mass of fatty amines and/or of derivatives thereof relative to the total weight of lubricant is chosen such that the BN provided by these compounds represents at least 30% of the BN of said cylinder lubricant.

20. The cylinder lubricant according to claim 17, in which the percentage by mass of fatty amines and/or of derivatives thereof relative to the total weight of lubricant is chosen such that the BN provided by these compounds represents at least 50% of the BN of said cylinder lubricant.

21. The cylinder lubricant according to claim 6, wherein R represents the fatty chain of oleic acid.

22. The cylinder lubricant according to claim 7, wherein R represents the fatty chain of oleic acid.

23. The cylinder lubricant according to claim 10, wherein the overbased and/or neutral detergents are compounds based on metals selected from the group consisting of calcium and magnesium.

24. The cylinder lubricant according to claim 12, wherein the percentage by mass of overbased detergents relative to the total weight of lubricant is chosen such that the BN provided by the metallic carbonate salts represents a contribution of at least 10 milligrams of potash per gram of lubricant to the BN of said cylinder lubricant.

25. The cylinder lubricant according to claim 13, wherein the percentage by mass of overbased detergents relative to the total weight of lubricant is chosen such that the organic BN provided by the detergent metallic soaps represents a contribution of at least 10 milligrams of potash per gram of lubricant to the BN of said cylinder lubricant.

26. The cylinder lubricant according to claim 14, wherein the kinematic viscosity of which, measured according to standard ASTM D445 at 100° C., is between 16.3 and 21.9 cSt.

27. A cylinder lubricant having a BN, determined according to standard ASTM D-2896, greater than or equal to 15 milligrams of potash per gram of lubricant, comprising:

a) one or more thickening and/or viscosity improving VI polymers, optionally in combination with one or more lubricating base oils for marine engines, b) at least one overbased detergent, wherein said overbased detergent is an alkali or alkaline-earth metal-based detergent overbased with metallic carbonate salts, optionally in combination with one or more neutral detergents, c) one or more oil-soluble fatty amines and/or fatty amine derivatives, having a BN determined according to standard ASTM D-2896 between 150 and 600 milligrams of potash per gram, the percentage by mass of fatty amines and/or of derivatives thereof relative to the total weight of lubricant being chosen such that the BN provided by the fatty amines and/or derivatives thereof represents a contribution of at least 10 milligrams of potash per gram of lubricant, to the total BN of said cylinder lubricant and, the percentage by mass of overbased detergents relative to the total weight of lubricant being chosen such that the BN provided by the metallic carbonate salts represents a contribution of at most 20 milligrams of potash per gram of lubricant to the total BN of said cylinder lubricant.

28. A method of lubricating a cylinder in an engine combusting a fuel oil comprising contacting said cylinder with a lubricant according to claim 1, wherein said fuel oil has a sulphur content of less than 1.5% m/m or greater than 3% m/m.

29. The method according to claim 28, wherein said fuel oil has a sulphur content of less than 1% m/m or greater than 3.5% m/m.

* * * * *